US006224456B1

(12) United States Patent
Wittenberg

(10) Patent No.: US 6,224,456 B1
(45) Date of Patent: May 1, 2001

(54) DOLL HAVING AN ARM MOVEMENT MECHANISM USING A REAR-FACING LEVER

(75) Inventor: Mark Wittenberg, Anaheim, CA (US)

(73) Assignee: Mattel, Inc., El Segundo ( * ) Notice: Subject to any disclaimer, the term of this patent is extended or adjusted under 35 U.S.C. 154(b) by 0 days.

(21) Appl. No.: 09/632,336

(22) Filed: Aug. 3, 2000

(51) Int. Cl.[7] ..... A63H 3/20; A63H 3/46
(52) U.S. Cl. ..... 446/330; 446/376; 446/383
(58) Field of Search ..... 446/327, 330, 446/336, 352, 376, 383, 390

(56) References Cited

U.S. PATENT DOCUMENTS

| | | | | |
|---|---|---|---|---|
| 2,381,897 | | 8/1945 | Geller . | |
| 2,764,841 | | 10/1956 | Birnbaum . | |
| 3,147,566 | | 9/1964 | Ong . | |
| 3,758,982 | | 9/1973 | Lemelson et al. . | |
| 3,955,311 | | 5/1976 | Lyons et al. . | |
| 4,069,613 | | 1/1978 | Lemelson et al. . | |
| 4,126,961 | | 11/1978 | Barlow et al. . | |
| 4,186,518 | | 2/1980 | Luke . | |
| 4,504,241 | | 3/1985 | Dyson et al. | 446/304 |
| 4,579,542 | * | 4/1986 | Meyer et al. | 446/330 |
| 4,721,489 | | 1/1988 | Galoob | 446/23 |
| 4,723,932 | * | 2/1988 | Kelley et al. | 446/330 |
| 4,802,878 | | 2/1989 | Terzian et al. | 446/300 |
| 5,334,069 | | 8/1994 | Liu | 446/23 |
| 5,394,766 | | 3/1995 | Johnson et al. | 74/490.01 |
| 5,545,072 | | 8/1996 | Arad et al. | 446/268 |
| 6,022,263 | | 2/2000 | Liu et al. | 446/379 |
| 6,062,941 | * | 5/2000 | Cook | 446/330 X |
| 6,132,285 | * | 10/2000 | Feldman | 446/330 X |

* cited by examiner

*Primary Examiner*—John A. Ricci
(74) *Attorney, Agent, or Firm*—Roy A. Ekstrand

(57) ABSTRACT

A doll includes a pair of arms, a pair of legs and a head supported by a doll torso. One of the doll arms is secured to the torso at a shoulder joint which includes the outer end of an arm movement mechanism. The arm movement mechanism includes an arm shaft pivotally supported at the shoulder joint of the doll at one end and having a ball at the interior end thereof. The arm movement mechanism within the doll further includes a slidably supported traveler having a spring urging the traveler toward one end of its motion. The traveler includes a rearwardly extending lever passing through an aperture formed in the doll torso. The traveler defines a socket which receives the ball end of the arm shaft in a pivotal attachment. As the user moves the lever upon the doll torso, the arm shaft is pivoted causing a corresponding pivotal movement of the doll arm.

11 Claims, 2 Drawing Sheets

40
41
34
30
33
32
31
36
35
38
45
15
56
52
53
54
55
61
50
51
22
58
59
57
60
72
33
30
34
45
32
55
31
52
53
51
67
75
40
17
46
36
37
68
22
71
74
15
73
70
76
79
78
57
58
59
60
16
66
65
11
10
13
14

DOLL HAVING AN ARM MOVEMENT MECHANISM USING A REAR-FACING LEVER

SPECIFICATION

1. Field of the Invention

This invention relates generally to dolls and toy figures and particularly to dolls and toy figures having limbs movable in response to a manually actuated mechanism.

2. Background of the Invention

Dolls having movable limbs are well known in the art and have been provided for many years. A great number of so-called "posable" dolls have been provided having limbs or other appendages which are directly movable by hand manipulation of the limb or appendage. The posable quality of such dolls and toy figures arises from their tendency to maintain a particular position once moved by the user. Other types of dolls and toy figures having movable limbs or other appendages utilize some type of movement mechanism to provide their movement. Such mechanized dolls and toy figures are generally categorized as either powered or manual. Powered mechanisms utilize some type of motor such as a battery-driven electric motor or a spring-driven wind-up motor to operate the mechanism. Manual movement mechanisms typically use an indirect movement, that is to say one or more limbs are movably supported upon the doll or toy figure such as arms or legs while an additional movable lever or tab is positioned elsewhere on the doll or toy figure. An operative drive mechanism couples the movement of the lever or tab to the movably supported limb to provide the desired movement as the lever or tab is manipulated. In many dolls and toy figures having movable limbs, the degree of movement of the movable limb is intended to resemble or replicate a particular well known movement undertaken by humans. For example, U.S. Pat. No. 3,955,311 issued to Lyons, et al. sets forth a MECHANISM FOR MOVING AN UPPER APPENDAGE OF A TOY FIGURE in which a push button on the upper side of the toy figure torso is hand-operated to transmit motion to a mechanism within the doll torso. An arm is pivotally movable upon the torso and coupled to the mechanism and further holds a toy sword. When the button is moved, the arm pivots raising and lowering the sword in a combat maneuver.

U.S. Pat. No. 4,126,961 issued to Barlow, et al. sets forth an ARTICULATED DOLL having a torso and pivotally supported head. A ball and socket joint supports a toggle which extends outwardly from the rear torso and inwardly into the torso cavity. A lever and pivot mechanism couples the movement of the interior end of the toggle to the head support to cause the doll's head to nod.

U.S. Pat. No. 3,758,982 issued to Lemelson, et al. sets forth an ACTIVITY DOLL having a hollow body and one or more pivotally mounted limbs. A push button mechanism is supported at the rear torso and an internal drive gear system converts the in and out movement of the button against the torso to pivotal movement of the limb. A similar mechanism is set forth in U.S. Pat. No. 4,069,613 also issued to Lemelson, et al.

U.S. Pat. No. 6,022,263 issued to Liu, et al. sets forth MECHANICAL TOY FIGURES having upper and lower torsos rotatably attached together with arms and legs rotatably secured to the upper torso. A spring connected to the lower torso and upper torso rotates the upper torso between first and second positions. A friction clutch retards or slows the torso movement. A gear drive is connected to the lower torso and is operative to move an arm shaft which in turn moves the arms.

U.S. Pat. No. 4,186,518 issued to Luke sets forth a KICKING DOLL WITH DETACHABLE TRIGGER MEANS in which a doll supports a pivotally movable leg and a gear drive system operative to cause the leg to undergo a rapid kicking motion. An external trigger is provided which is secured to the doll torso and operative to release the kicking mechanism.

U.S. Pat. No. 4,721,489 issued to Galoob sets forth an ILLUMINABLE FIGURE which includes a movement mechanism operative upon the doll to provide arm motion.

U.S. Pat. No. 4,802,879 issued to Terzian, et al. sets forth a DOLL WITH ROTATING AND BENDABLE ARMS having an infant doll figure supporting a pair of pivotally movable bendable arms. A rotatable wheel is supported at the rear torso of the doll and is coupled by a gear mechanism to arm bending and movement apparatus within the doll.

U.S. Pat. No. 5,334,069 issued to Liu, Dexter C. sets forth an ACTION CHARACTER FIGURE WITH SPARKING MECHANISM having a doll supporting a pivotable arm and a spark-producing mechanism. The pivoting arm and spark-producing mechanism are moved simultaneously by a common drive system.

U.S. Pat. No. 5,394,766 issued to Johnson, et al. sets forth a ROBOTIC HUMAN TORSO which simulates the size, appearance and movements of a human torso. The torso includes a combination of high speed rotary and linear actuators arranged in a geometry that enable anatomically correct human-like movement.

U.S. Pat. No. 5,545,072 issued to Arad, et al. sets forth an IMAGE-PROJECTIVE TOY having a torso supporting a projecting lens in the frontal surface thereof. A light source within the torso produces a beam of light directed forwardly and outwardly through the projecting lens. A rotatable wheel within the torso supports a plurality of film segments movable by rotation thereof into alignment with the light beam and projecting lens. Rotation of the film wheel is accomplished by a rearwardly extending shaft and a knob supported at the rear of the torso.

U.S. Pat. No. 4,504,241 issued to Dyson, et al. sets forth a TOY FIGURE WITH MANUALLY OPERABLE INGESTION SYSTEM which simulates eating and digestion in response to movement of a rear supported lever.

Additional examples of early doll structures having movable limbs are found in U.S. Pat. No. 2,381,897 issued to Geller, U.S. Pat. No. 2,764,841 issued to Birbaum, and U.S. Pat. No. 3,147,566 issued to Liu Hong Ong.

While the foregoing described prior art devices have to some extent improved the doll and toy figure art and have in some instances enjoyed commercial success, there remains nonetheless a continuing need in the art for evermore improved, interesting and amusing dolls and toy figures.

SUMMARY OF THE INVENTION

Accordingly, it is a general object of the present invention to provide an improved doll or toy figure. It is a more particular object of the present invention to provide an improved doll or toy figure which utilizes a simple but effective manually actuatable mechanism for moving a limb or appendage.

In accordance with the present invention, there is provided a doll comprising: a torso defining a rear surface having a slot formed therein, a shoulder socket and a torso interior; an arm having a ball end defining a slot, the ball end pivotably movable within the shoulder socket, an arm shaft having an outer end defining a shoulder flange received within the slot supporting the arm in the shoulder socket and an inner end extending inwardly into the torso interior, the inner end of the arm shaft defining an arm shaft ball; a traveler slidably movable within the torso interior having a lever extending rearwardly through the slot and an upper end defining a socket receiving the arm shaft ball, the traveler being movable between first and second positions causing the arm shaft to pivot between first and second angular positions; and a spring coupled to the traveler urging the traveler toward the first position, the traveler and the arm shaft cooperating to pivotally move the arm as the traveler is moved between the first and second positions and the arm shaft is pivoted between the first and second angular positions.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
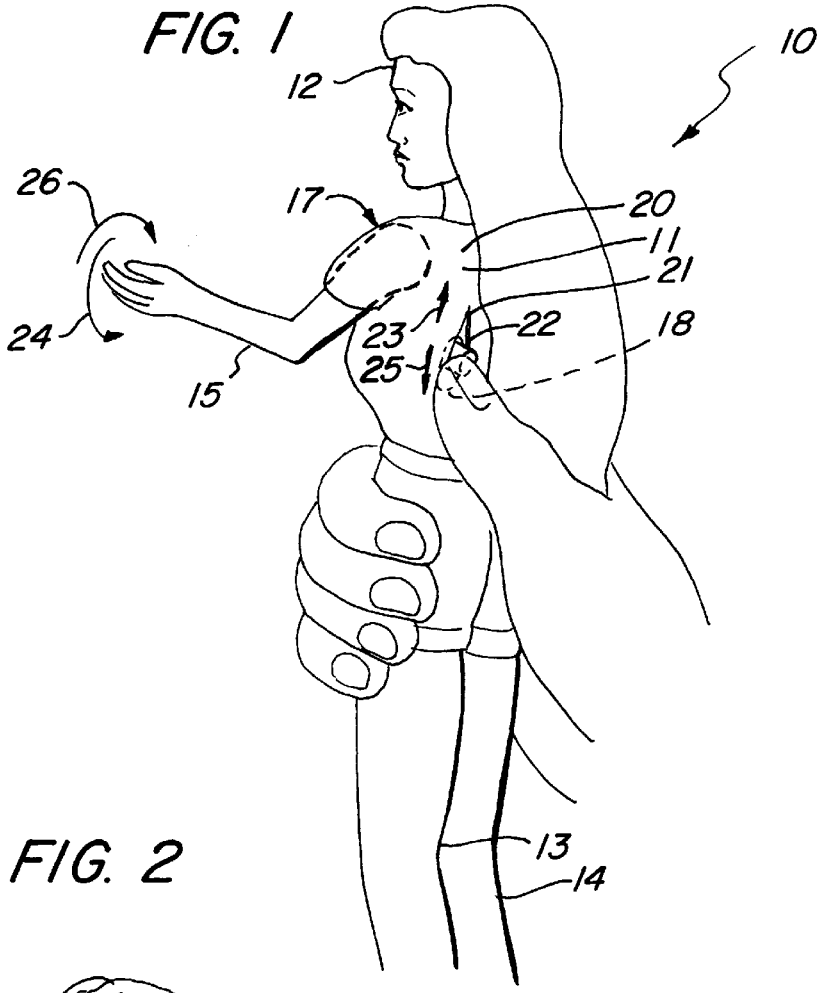
FIG. 1 sets forth a rear perspective view of a doll having an arm movement mechanism constructed in accordance with the present invention.

FIG. 1 sets forth a rear perspective view of a doll constructed in accordance with the present invention and generally referenced by numeral 10. It will be apparent to those skilled in the art that while the present invention is shown in a doll generally resembling a "fashion doll", the present invention applies equally well to other types of dolls and other toy figures. Accordingly, as used herein, the term "doll" will be understood to include other types of dolls as well as different types of toy figures.

Doll 10 includes a torso 11 supporting a head 12 and a pair of legs 13 and 14. Doll 10 further includes a pair of arms 15 and 16 (arm 16 seen in FIG. 2). In accordance with the present invention, arm 15 is supported upon torso 11 at a shoulder joint 17. The structure of shoulder joint 17 is set forth below in greater detail. However, suffice it to note here that arm 15 is pivotally supported upon torso 11 by shoulder joint 17. A garment 20 having an aperture 21 formed therein is shown worn upon torso 11. Aperture 21 facilitates the extension of a lever 22 to the exterior of doll 10. In accordance with the operation of the present invention arm movement mechanism set forth below in greater detail, the user is able to grasp doll 10 in the fashion shown and is able to move lever 22 upwardly in the direction indicated by arrow 23 and downwardly in the direction indicated by arrow 25. By means set forth below in FIG. 4 in greater detail, the downward movement in the direction indicated by arrow 25 is achieved by overcoming the force of an internal spring within torso 11. Conversely, the upward movement of lever 22 in the direction indicated by arrow 23 results from the release of lever 22 allowing the internal spring shown in FIG. 4 as spring 66 to restore lever 22 upwardly in the direction indicated by arrow 23. In accordance with the operative mechanism set forth below, the downward movement of lever 22 causes arm 15 to pivot about shoulder joint 17 in the direction indicated by arrow 26. Conversely, the upward movement of lever 22 causes arm 15 to pivot about shoulder joint 17 in the direction indicated by arrow 24. The character of movement of arm 15 in response to the up and down movement of lever 22 varies with the pivotal positioning of arm 15 upon shoulder joint 17.

Figure 2:
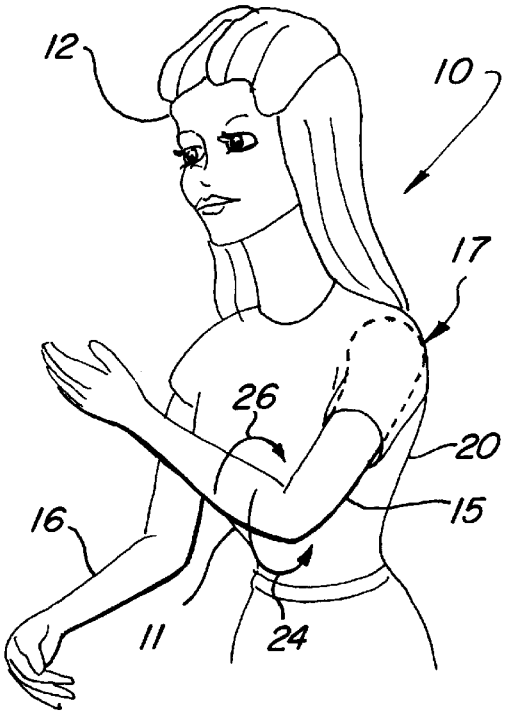
FIG. 2 sets forth a partial front perspective view of the inventive doll of FIG. 1.

Thus, in the forwardly extending arm position shown in FIGS. 1 and 2, movement of lever 22 results in a rotating or arm twisting motion. In contrast and with temporary reference to FIG. 4, the positioning of arm 15 in a downward or arms at the side position results in a pivotal movement of arm 15 toward torso 11 or away from torso 11. Further and with continued temporary reference to FIG. 4, the positioning of arm 15 in a raised position results in pivoting arm 15 toward or away from head 12 in response to movement of lever 22. Thus, in accordance with an important aspect of the present invention, the arm movement mechanism facilitates different types of arm movement in accordance with the posed arm position.

FIG. 2 sets forth a front perspective view of doll 10 having a torso 11 supporting a head 12 and arms 15 and 16. Arm 15 is supported upon torso 11 at a shoulder joint 17. A garment 20 is worn upon torso 11 and, as is set forth above in FIG. 1, includes an aperture 21 through which lever 22 extends.

FIG. 2 shows the twisting pivoting movement of arm 15 in response to movement of lever 22 (seen in FIG. 1). Thus, with arm 15 extended generally forwardly as shown in FIGS. 1 and 2, the pivotal motion of arm 15 in response to movement of lever 22 is described by the twisting motion indicated by arrows 24 and 26.

Figures 3, 4:
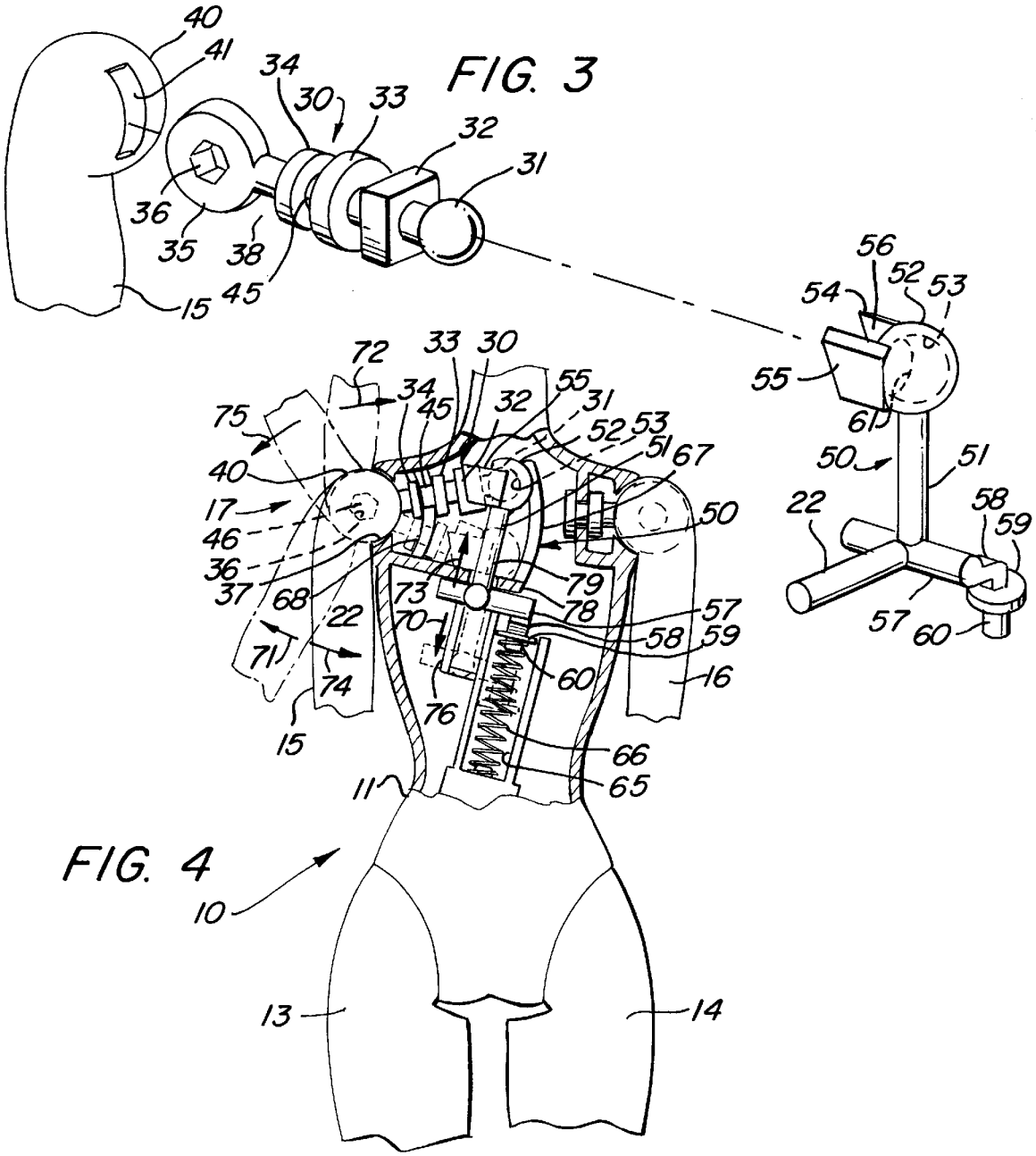
FIG. 3 sets forth a perspective assembly view of the present invention arm movement mechanism.
FIG. 4 sets forth a partially sectioned rear view of a doll having the present invention arm movement mechanism therein.

FIG. 3 sets forth a perspective assembly view of the present invention arm movement mechanism separated from the remainder of doll 10. The movement mechanism includes three basic components, an arm shaft 30, a traveler 50 and arm 15 itself. Arm 15 defines a spherical portion forming a shoulder ball 40 having a slot 41 formed therein. As is better seen in FIG. 4, arm 15 further includes a pin 46 extending into slot 41.

Arm shaft 30 includes a ball 31 and a generally rectangular slide 32 in a spaced apart arrangement. Arm shaft 30 further includes a flange 33 spaced from slide 32 and a flange 34. Flange 34 is spaced apart from flange 33 allowing arm shaft 30 to define a bearing portion 45 which as is set forth below in FIG. 4 is movable upon a curved guide 68. Arm shaft 30 further includes a generally cylindrical or disk-shaped arm flange 35 having a faceted aperture 36 formed therein. As is better seen in FIG. 5, slide 32 is formed upon shaft 64 as an inserted molded component resulting in a tight fit rotational attachment between slide 32 and shaft 64. The structure of this rotational attachment is set forth in FIG. 5 in greater detail. However, suffice it to note here that the rotational attachment between flange 33 and shaft 64 allows rotation of arm flange 35 with respect to slide 32 in the manner indicated by arrows 38. This frictional and rotational attachment allows the rotational position of arm 15 about shoulder joint 17 (seen in FIG. 2) to be poseable.

Traveler 50 includes a shaft 51 supporting a ball end 52 within which a socket recess 53 is formed. Socket recess 53 defines an aperture 61 sufficient in size to receive ball 31 of arm shaft 30 in a force fit attachment. Traveler 50 further includes a pair of generally planar guide plates 54 and 55 positioned on each side of aperture 61. Traveler 50 further includes an arm 57 supporting a rearwardly extending lever 22 and a bracket 58. Bracket 58 in turn supports a flange 59 in a downwardly extending post 60.

In operation, arm 15 is assembled to arm flange 35 by forcing arm flange 35 through slot 41 and allowing it to engage pin 46 within faceted aperture 36. This engagement is preferably a snap-fit engagement. However, pin 46 may be separately fabricated and installed within shoulder ball 40 as desired. The resulting attachment of arm flange 35 and shoulder ball 40 of arm 15 provides a friction fit therebetween whereby the angular position of arm 15 upon arm flange 35 may be adjusted and "posed". The assembly of arm shaft 30 to traveler 50 is accomplished by aligning ball 31 with aperture 61 of socket recess 53 and further aligning slide 32 with space 56 formed between plates 54 and 55. Thereafter, assembly is completed by forcing ball 31 into socket 43 through aperture 61. In the preferred fabrication of the present invention, ball 31 then fits within socket recess 53 with sufficient clearance to allow free pivoting movement therebetween. The position of slide 32 within space 56 aligns a pair of opposed sides of slide 32 between plates 54 and 55 such that rotation of slide 32 about the axis of arm shaft 30 is precluded and the remainder of armshaft 30 and arm 15 may be rotated and posed in the directions indicated by arrows 38. At this point, the combined structure of arm 15, arm shaft 30 and traveler 50 is ready for installation within the remainder of doll 10.

FIG. 4 sets forth a partially sectioned rear view of doll 10 showing the interior of torso 11. As described above, doll 10 includes a pair of legs 13 and 14 secured to torso 11 in accordance with conventional fabrication techniques. Doll 10 further includes a head 12 (seen in FIG. 1) which has been omitted in FIG. 4. An arm 16 is pivotally secured to torso 11 utilizing a conventional fabrication shoulder joint. In accordance with the present invention, arm 15 is joined to torso 11 at a shoulder joint generally referenced by numeral 17. Torso 11 defines a socket surface 37 which cooperates with ball end 40 of arm 15 to facilitate the pivotal movement of arm 15. Arm 15 is shown in a downwardly extending position in solid-line representation in FIG. 4.

In further accordance with the present invention, a spring channel 65 is formed within the interior of torso 11 and supports a spring 66. Torso 11 further includes an interior plate 78 defining an aperture 79 therein. A pair of curved guides 67 and 68 extend upwardly from interior plate 78. An arm shaft 30 includes an arm flange 35 secured within a slot 41 of shoulder ball 40 in the manner set forth above in FIG. 3. Arm shaft 30 further includes a pair of flanges 33 and 34 received along each side of curved guide 68. A bearing surface 45 extends between flanges 33 and 34 and moves upon curved guide 68. Arm shaft 30 further includes a bail 31 received within socket 53 of traveler 50 and a slide 32 received between plates 55 and 54 (plate 54 seen in FIG. 3) of traveler 50. Traveler 50 further includes a ball end 52 which moves upon curved guide 67. Traveler 50 further includes a shaft 51 extending downwardly through aperture 79 of interior plate 78. An arm 57 extends transversely upon traveler 50 beneath interior plate 78 and supports a rearwardly extending lever 22. A bracket 58 extends downwardly from one end of arm 57 and supports a flange 59 and a post 60. Post 60 engages the upper end of spring 66 supported within spring channel 65 of torso 11.

In operation, spring 66 urges traveler 50 upwardly in the direction indicated by arrow 73 until arm 57 abuts the undersurface of interior plate 78. At this point, the position of traveler 50 is established as shown in solid-line representation in FIG. 4. correspondingly, arm shaft 30 assumes the pivotal position within shoulder socket 37 shown in solid-line representation. It will be noted that the relative positions of traveler 50 and arm shaft 30 in the solid-line position shown is facilitated by the pivoting of ball 31 within socket 33.

Once the user initiates operation of doll 10, lever 22 is orced downwardly in the direction indicated by arrow 70 overcoming the force of spring 66 and moving traveler 50 downwardly to the dashed-line position shown in FIG. 4. Correspondingly, the downward movement of traveler 50 pivots arm shaft 30 to the dashed-line position shown. Curved guides 67 and 68 facilitate this downward pivotal movement. The engagement of arm 15 with arm shaft 30 described above causes arm 15 to pivot outwardly in the direction indicated by arrow 71 to the dashed-line position.

The user thereafter releases lever 22 allowing spring 66 to move traveler 50 upwardly in the direction indicated by arrow 73 and returning it to the solid-line position shown. This upward movement of traveler 50 pivots arm shaft 30 correspondingly and causes arm 15 to pivot toward torso 11 in the direction indicated by arrow 74. Thus, as the user continues to moves lever 22 downwardly and release it, arm 15 undergoes a pivotal movement between the solid-line position shown and the dashed-line position shown in the directions indicated by arrows 71 and 74.

In accordance with the present invention, arm 15 may be pivoted with respect to arm shaft 30 to "pose" arm 15 and thereby adjust the type of motion imparted to arm 15 as traveler 50 is moved. Thus, in addition to the side-to-side motion indicated by arrows 71 and 74, arm 15 may be pivoted forwardly to the position shown in FIG. 1 in which case the above-described twisting movement of arm 15 occurs in response to movement of lever 22. It will be recalled by returning to FIGS. 1 and 2 that this twisting motion of arm 15 is indicated by arrows 24 and 26 therein.

Returning to FIG. 4, a further alternative posing of arm 15 may be achieved by pivoting arm 15 upwardly to an arms raised position as shown in dashed-line representation. In this event, the movement of traveler 50 downwardly in the direction indicated by arrow 70 causes arm 15 to move in the direction indicated by arrow 72 toward the head of doll 10 (head 12 seen in FIG. 1). Conversely, the release of lever 22 allows spring 66 to return traveler 50 to the solid-line position shown in FIG. 4 causing arm 15 to pivot away from head 12 in the direction indicated by arrow 75.

Thus, in accordance with an important aspect of the present invention, the ability of arm 15 to be alternatively posed allows a corresponding variation in the type of motion achieved by the arm movement mechanism. It will be recalled from the descriptive material associated with FIG. 3 that arm shaft 30 is formed of a pair of rotationally movable components which allows arm flange 35 (also seen in FIG. 3) to be rotatable about the axis of arm shaft 30. Returning to FIG. 4, it will be apparent that this ability of pivotal movement allows arm 15 to be pivoted between the downwardly extending position shown in solid-line representation to the forwardly extending position shown in FIGS. 1 and 2 and to the arms raised position shown in dashed-line representation in FIG. 4.

Figure 5:
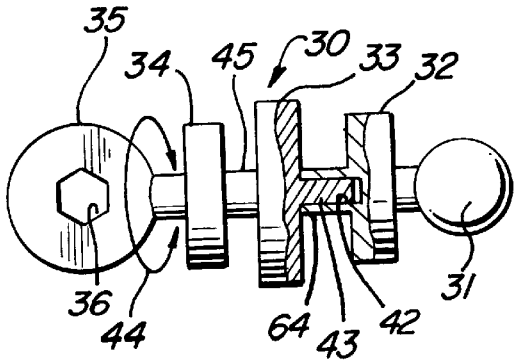
FIG. 5 sets forth a partially sectioned view of the arm shaft portion of the present invention arm movement mechanism.

FIG. 5 sets forth a partially sectioned view of arm shaft 30. Of importance to note in FIG. 5 is the frictional and rotational coupling provided between slide 32 and shaft 64 of arm shaft 30. More specifically, arm shaft 30 includes a ball 31, a shaft 64 and a generally rectangular slide 32. Slide 32 is preferably insert molded upon a shaft 64 such that slide 32 defines an internal bore 42 which is tight upon shaft 64 to provide the above-mentioned frictional fit. Arm shaft 30 further includes a flange 34 and a bearing 45 positioned between flange 34 and flange 33. Finally, arm shaft 30 includes a generally disk-shaped arm flange 35 having a faceted aperture 36 formed therein. Thus, arm flange 35 is rotatable and poseable about the axis of arm shaft 30 in the directions indicated by arrows 44 due to the frictional attachment of slide 32 upon shaft 64. It will be noted that the cooperation of curved guide 68 (seen in FIG. 4) upon bearing 45 and between flanges 33 and 34 prevents separation of arm shaft ball 31 from socket 53 when arm shaft 30 is assembled within the present invention doll. This, in turn, prevents the inadvertent separation of arm 15 from torso 11 (seen in FIG. 4) once arm shaft 30 is assembled within the doll torso.

What has been shown is a doll having an arm movement mechanism which responds to a rear facing lever to provide a posable arm and movement thereof. The structure shown and described is readily fabricated of a minimum number of low cost mass-produced components. The majority of components utilized therein may be readily fabricated using conventional injection molded plastic apparatus.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a torso defining a rear surface having a slot formed therein, a shoulder socket and a torso interior;

an arm having a ball end defining a slot, said ball end pivotably movable within said shoulder socket;

an arm shaft having an outer end defining a shoulder flange received within said slot supporting said arm in said shoulder socket and an inner end extending inwardly into said torso interior, said inner end of said arm shaft defining an arm shaft ball;

a traveler slidably movable within said torso interior having a lever extending rearwardly through said slot and an upper end defining a socket receiving said arm shaft ball, said traveler being movable between first and second positions causing said arm shaft to pivot between first and second angular positions; and a spring coupled to said traveler urging said traveler toward said first position, said traveler and said arm shaft cooperating to pivotally move said arm as said traveler is moved between said first and second positions and said arm shaft is pivoted between said first and second angular positions.

2. The doll set forth in claim 1 wherein said torso includes a first curved guide for guiding said arm shaft ball as said arm shaft pivots.

3. The doll set forth in claim 2 wherein said torso includes a second curved guide and wherein said arm shaft includes first and second flanges on each side of said second guide.

4. The doll set forth in claim 3 wherein said arm shaft includes a slide, frictionally supported near said arm shaft ball, having opposed facets and wherein said traveler includes a pair of plates adjacent said socket overlapping said opposed facets and preventing said slide from rotating.

5. The doll set forth in claim 4 wherein said slide frictionally resists rotation of said arm shaft.

6. The doll set forth in claim 1 wherein said arm shaft includes a slide, frictionally supported near said arm shaft ball, having opposed facets and wherein said traveler includes a pair of plates adjacent said socket overlapping said opposed facets and preventing said slide from rotating.

7. The doll set forth in claim 6 wherein said slide frictionally resists rotation of said arm shaft.

8. The doll set forth in claim 1 wherein said torso includes a first curved guide for guiding said arm shaft ball as said arm shaft pivots.

9. A doll comprising:

a torso defining a rear surface having a slot therein, a torso interior, a shoulder socket, a first curved guide proximate said shoulder socket, a second curved guide spaced from said first curved guide;

a doll arm having a ball end received within said shoulder socket, said ball end defining a slot;

an arm shaft having an outer end defining an arm flange received within said slot, a pair of flanges on each side of said first curved guide, and an inner end defining an arm shaft ball;

a traveler, slidably supported within said torso interior and movable between first and second positions, having a lever extending through said slot in said torso and a socket receiving said arm shaft ball; and a spring coupled to said traveler urging said traveler toward said first position, said lever being moved within said slot to move said traveler between said first and second positions and causing said arm shaft and said arm to pivot about said shoulder socket.

10. The doll set forth in claim 9 wherein said arm shaft includes a faceted slide frictionally secured between said ball and said second flange and wherein said traveler includes a pair of plates engaging said faceted slide.

11. The doll set forth in claim 10 wherein said arm shaft includes a rotational coupling securing said second flange to said slide.

* * * * *